US006523384B1

(12) United States Patent
Schoch

(10) Patent No.: US 6,523,384 B1
(45) Date of Patent: Feb. 25, 2003

(54) CARRY THROUGH MONITOR

(75) Inventor: Daniel A. Schoch, Minster, OH (US)

(73) Assignee: The Minster Machine Company, Minster, OH (US)

( * ) Notice: Subject to any disclaimer, the term of this patent is extended or adjusted under 35 U.S.C. 154(b) by 0 days.

(21) Appl. No.: 09/679,667

(22) Filed: Oct. 4, 2000

Related U.S. Application Data

(60) Provisional application No. 60/159,815, filed on Oct. 15, 1999.

(51) Int. Cl.[7] ..... B21C 51/00

(52) U.S. Cl. ..... 72/20.1; 72/17.2; 72/19.8; 72/20.2; 72/373

(58) Field of Search ..... 72/17.2, 19.8, 72/20.1, 20.2, 373, 441, 443; 100/50, 51; 700/145

(56) References Cited

U.S. PATENT DOCUMENTS

| | | | | |
|---|---|---|---|---|
| 4,195,563 A | | 4/1980 | Budraitis et al. | |
| 4,429,627 A | | 2/1984 | Edsö | |
| 4,504,920 A | | 3/1985 | Mickowski | |
| 4,633,720 A | | 1/1987 | Dybel et al. | |
| 4,750,131 A | | 6/1988 | Martinez | |
| 4,945,742 A | | 8/1990 | Schoch | |
| 4,987,528 A | | 1/1991 | O'Brien | |
| 5,009,091 A | * | 4/1991 | Hinterman et al. | 72/17.2 |
| 5,068,779 A | | 11/1991 | Sullivan et al. | |
| 5,094,107 A | | 3/1992 | Schoch | |
| 5,140,834 A | | 8/1992 | Kashiwagi et al. | |
| 5,199,290 A | | 4/1993 | Kashiwagi et al. | |
| 5,224,053 A | | 6/1993 | Cook | |
| RE34,559 E | | 3/1994 | Mickowski | |
| 5,299,478 A | * | 4/1994 | Schorn et al. | 72/20.2 |
| 5,379,688 A | | 1/1995 | Ishii | |
| 5,491,647 A | | 2/1996 | O'Brien et al. | |
| 5,587,633 A | * | 12/1996 | Aoki et al. | 72/20.1 |
| 5,673,601 A | * | 10/1997 | Ejima et al. | 72/19.8 |
| 5,746,122 A | | 5/1998 | Gietz et al. | |
| 5,915,293 A | * | 6/1999 | Welsh et al. | 72/448 |

* cited by examiner

*Primary Examiner*—Ed Tolan
(74) *Attorney, Agent, or Firm*—Randall J. Knuth

(57) ABSTRACT

An apparatus and method for monitoring the carry through state of a mechanical press is disclosed. Actual slide displacement curves under load conditions are continually generated for the press being monitored. Values of rebound height, rebound count, and rebound number for the press slide may then be determined and utilized as indicators of the carry through state of the press. Measured values of rebound height, rebound count, and rebound number can then be displayed and used as indicators that the energy of the slide should be increased to bring the press closer to a carry through state.

39 Claims, 4 Drawing Sheets

CARRY THROUGH MONITOR

CROSS-REFERENCE TO RELATED APPLICATIONS

This application relates to and claims the benefit under 35 U.S.C. §119 of Provisional Application Ser. No. 60/159,815 filed Oct. 15, 1999 by the same inventor.

BACKGROUND OF THE INVENTION

1. Field of the Invention

The present invention relates generally to a method and apparatus for monitoring the carry through condition of a mechanical press. A mechanical press tends toward a dynamic carry through condition as the kinetic energy buildup present within the slide exceeds the kinetic energy and load requirements of the application needed to blank or form the part and thus, reduces or eliminates bounce, rebound, or dwell experienced as the slide contacts the stock material is reduced or even eliminated. Specifically, the present invention utilizes characteristics of an actual slide displacement curve to determine the operational state of a press being monitored relative to a dynamic carry through condition.

2. Description of the Related Art

Mechanical presses of the type performing stamping and drawing operations employ a conventional construction which includes a frame structure having a crown and a bed and which supports a slide in a manner enabling reciprocating movement toward and away from the bed. These press machines are widely used for a variety of workpiece operations and employ a large selection of die sets with the press machine varying considerably in size and available tonnage depending upon its intended use.

The flywheel assembly serves as the primary source of stored mechanical energy and rotary driving power in a mechanical press. Standard press configurations have the flywheel located between the main drive motor and clutch, with the flywheel being mounted on either the driveshaft, crankshaft or press frame by the use of a quill. The main drive motor replenishes the flywheel with rotational energy as it becomes depleted due to press stamping operations, during which the clutch engages the flywheel and establishes a driving connection between the flywheel and the crankshaft. When the crankshaft and flywheel are engaged in driving relationship, the flywheel energy is usefully converted into mechanical work to power the press components including the slide. During engagement of the clutch, the flywheel drops in speed as the press driven parts are brought up to running speed.

During press operation, the slide reciprocates up and down creating inertial forces on the press components. Balancer weights are utilized to dynamically balance these inertial forces. Guides are supplied to provide slide and balancer weight motion in the desired direction. As press speed increases, the vibration severity levels of the application within the press generally escalates.

As the press slide contacts the stock material and progresses to sheer material, the stock material fractures through and the release of stored energy sends a vibration shock wave through the press structure. When the slide contacts the stock material, it experiences a "bounce" or "dwell" as the slide movement is resisted by the stock material. This bounce at the snap through point of the stock material causes a decrease in the slide's kinetic energy, which energy must be replenished by the flywheel. Tending towards substantially eliminating slide bounce or dwell, as the slide contacts the stock material would signal that the press was approaching a theoretical pure carry through state. A theoretical pure carry through state would be achieved if slide bounce or swell, as the slide contacts the stock material was eliminated. Vibration introduced into the press structure from material fracture is lessened or potentially even eliminated as the press operating state tends toward a carry through condition. Similarly, the energy transfer requirements from the flywheel are lessened and may be potentially eliminated as press operating condition tends toward sufficient side kinetic energy which potentially achieves a theoretical pure carry through state.

What is needed in the art is a method and apparatus for monitoring the carry through condition of an operating press so that press operating conditions tending towards a theoretical pure carry through state can be determined and replicated and so that the requisite energy content of the slide required to achieve a carry through condition may be determined in order to reach a reduced level of vibration severity.

SUMMARY OF THE INVENTION

The present invention provides a method and apparatus for monitoring the carry through condition of a mechanical press. Specifically, the method and apparatus of the present invention utilizes measured quantities relating to the "bounce", "rebound", or "dwell" experienced as the slide contacts the stock material to measure press operating condition relative to a carry through state. These measured quantities include the bounce point and the return point or the dwell length. The bounce point apex corresponds to the position of the slide that is furthest from the contact point, i.e., where the slide contacts the stock material, and is between the contact point and the top dead center point of the slide on the downstroke and is reached after the slide contacts the stock material. The "return point" corresponds to the point at which the slide returns to a position that is the same distance from top dead center on the slide downstroke as the contact point. The distance from the contact point to the bounce point and from the contact point to the return point as measured along the ordinate and the abscissa respectively are utilized as indicators of the carry through condition of the mechanical press. Bounce number is additionally utilized as an indicator of the carry through condition of a mechanical press. Bounce number is a quantity which indicates the cumulative number of bounces experienced as the slide contacts the stock material. Dwell length is the time the slide is held immobile or reversing due to failure of material to fracture or sheer on control or resistance to the slide.

Adjustments to press operational parameters may then be made in an effort to bring the operational state of the press being monitored closer to a theoretical pure "carry through" state. Press operational parameters which may be adjusted in an effort to achieve a carry through state for a mechanical press include increasing the energy of the slide. Increased slide energy will allow the slide to perform the desired forming activity while experiencing less significant "bounce" as the slide motion is resisted by the stock material. While slide energy can be increased both by increasing slide velocity and by increasing slide mass, or speed increasing slide mass is preferred since increasing slide velocity leads to a more severe vibrational state of the press. These adjustments ensure no snap through hesitation of the slide occurs and therefore no discontinuous spike of energy is needed from the flywheel to build up slide energy to achieve snap through.

The invention, in one form thereof, comprises a method of achieving a carry through state in a mechanical press. This method includes the steps of: determining the rebound height of the slide as it contacts the stock material and adjusting press operational parameters in an effort to minimize the rebound height of the slide as it contacts the stock material or minimize dwell lenght.

The invention, in another form thereof, comprises a method of achieving a carry through state in a mechanical press. This method includes the steps of: determining the rebound height of the slide as it contacts the stock material, determining the rebound count of the slide as it contacts the stock material, and adjusting press operational parameters in an effort to minimize both the rebound height and the rebound count of the slide as it contacts the stock material.

The invention, in another form thereof, comprises a method of achieving a carry through state in a mechanical press. This method includes the steps of: determining the rebound height of the slide as it contacts the stock material; determining the rebound count of the slide as it contacts the stock material; determining the rebound number of the slide as it contacts the stock material; and adjusting press operational parameters in an effort to minimize the rebound height, rebound count, and rebound number of the slide as it contacts the stock material.

In one form of the current invention, determining the rebound height of the slide as it contacts the stock material is achieved by: determining the contact point where the slide contacts the stock material, determining the bounce point which corresponds to the position of the slide that is furthest from the contact point and is between the contact point and the top dead center point of the slide on the slide downstroke and which is reached after the slide contacts the stock material, determining the distance along the slide path between the contact point and the bounce point, and establishing the distance along the slide path between the contact point and the bounce point as the rebound height. This method of determining the rebound height of the slide as it contacts the stock material may further include the steps of: providing a computational device, communicating the contact point to the computational device, communicating the bounce point to the computational device, and using the computational device to compute the distance along the slide path between the contact point and the bounce point.

In one form of the current invention, the step of determining the contact point where the slide contacts the stock material includes the steps of: creating an actual slide displacement curve, determining the first inflection point on the actual slide displacement curve, and establishing the first inflection point on the actual slide displacement curve as the contact point. The step of creating an actual slide displacement curve may further include the steps of: providing a non-contact displacement sensor, monitoring slide position continuously during press operation, and plotting slide displacement versus a count quantity. The step of plotting slide displacement versus a count quantity may comprise: plotting slide displacement versus time or crank angle.

In one form of the current invention, rebound count is determined by: determining the return point which corresponds to the slide returning to a position that is the same distance from top dead center on the slide downstroke as the contact point, determining the count quantity elapsing between the slide reaching the contact point and the slide reaching the return point, and establishing the count quantity elapsing between the slide reaching the contact point and the slide reaching the return point as the rebound count. Determining the rebound count of the slide may further include the steps of: communicating the return point to a computational device, communicating the contact point to a computational device, and using the computational device to determine the count quantity elapsing between the slide reaching the contact point and the slide reaching the return point.

In one form of the current invention, the step of adjusting press operational parameters in an effort to minimize either the rebound height or the rebound count of the slide as it contacts the stock material comprises the step of: increasing the energy of the slide. Increasing the energy of the slide may be achieved by adding mass to the slide.

In one form of the current invention, rebound number is determined by: determining all inflection points which occur on the actual slide displacement curve from the dynamic top dead center position of the slide to the dynamic bottom dead center position of the slide and calculating a quantity of rebound number utilizing the inflection points occurring on the actual slide displacement curve from the dynamic top dead center position of the slide to the dynamic bottom dead center position of the slide. The step of calculating a quantity of rebound number utilizing the inflection points occurring on the actual slide displacement curve may comprise the steps of: generating a cumulative number of inflection points occurring on the actual slide displacement curve from the dynamic top dead center position of the slide to the dynamic bottom dead center position of the slide and establishing the cumulative number of inflection points occurring on the actual slide displacement curve as the rebound number, or dividing the cumulative number of inflection points occurring on the actual slide displacement curve by two and establishing the cumulative number divided by two as the rebound number. Rebound number is indicative of the number of bounces occurring as the slide contacts the stock material.

The invention, in another form thereof, comprises a method of achieving a carry through state in a mechanical press. This method includes the steps of: determining the rebound count of the slide as it contacts the stock material and adjusting press operational parameters in an effort to minimize the rebound count or dwell length of the slide as it contacts the stock material.

The invention, in another form thereof, comprises a method of achieving a carry through state in a mechanical press. This method includes the steps of: determining the rebound number of the slide as it contacts the stock material and adjusting press operational parameters in an effort to minimize the rebound number of the slide as it contacts the stock material.

The invention, in another form thereof, comprises a method of decreasing the vibration severity level of a mechanical press. This method comprises the steps of: monitoring the carry through condition of the press and adjusting press operational parameters in response to the monitored carry through condition of the press to bring the operational state of the press being monitored closer to a carry through state. The step of monitoring the carry through condition of the press may comprise the step of: determining the rebound height and/or rebound count and/or rebound number of the slide as it contacts the stock material.

In one form of the current invention, the step of adjusting press operational parameters in response to the monitored carry through condition of the press to bring the operational state of the press being monitored closer to a carry through state comprises the step of: increasing the kinetic energy of the slide. Increasing the kinetic energy of the slide may be accomplished by adding mass to the slide.

The invention, in another form thereof, comprises an apparatus useful to achieve a carry through state in a mechanical press having a reciprocating slide. The apparatus of this form of the current invention includes a computational device, a displacement sensor, and a display device. The displacement sensor is operatively connected to the press so that the displacement sensor may sense the location of the press slide during press operation. The displacement sensor is communicatively connected to the computational device and the computational device is operative to continually create an actual slide displacement curve for each pressing cycle of the press being monitored. The computational device is further operative to obtain values of rebound height and rebound count from the thusly generated slide displacement curves. The display device is communicatively connected to the computational device and is operative to display the computed values of rebound height and rebound count. The computational device may be, for example, a microprocessor. The displacement sensor may be a non-contact displacement sensor, for example, a hall effect sensor. The slide includes a plurality of areas operable for adding mass to the slide and therefore, increasing the kinetic energy of the slide in response to the displayed values of rebound height and rebound count.

An advantage of the present invention is the ability to monitor press performance characteristics which are indicative of the carry through condition of the press being monitored.

Another advantage of the present invention is the ability to utilize indicators of press carry through condition so that press operational parameters may be adjusted in an effort to create a press operational state closer to carry through and to achieve the reduction in press vibration severity resulting therefrom.

A further advantage of the present invention is the ability to recognize the energy state of the slide required to achieve a carry through condition in a mechanical press and to decrease the size of or eliminate entirely the flywheel based upon the energy state of the slide.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 2:
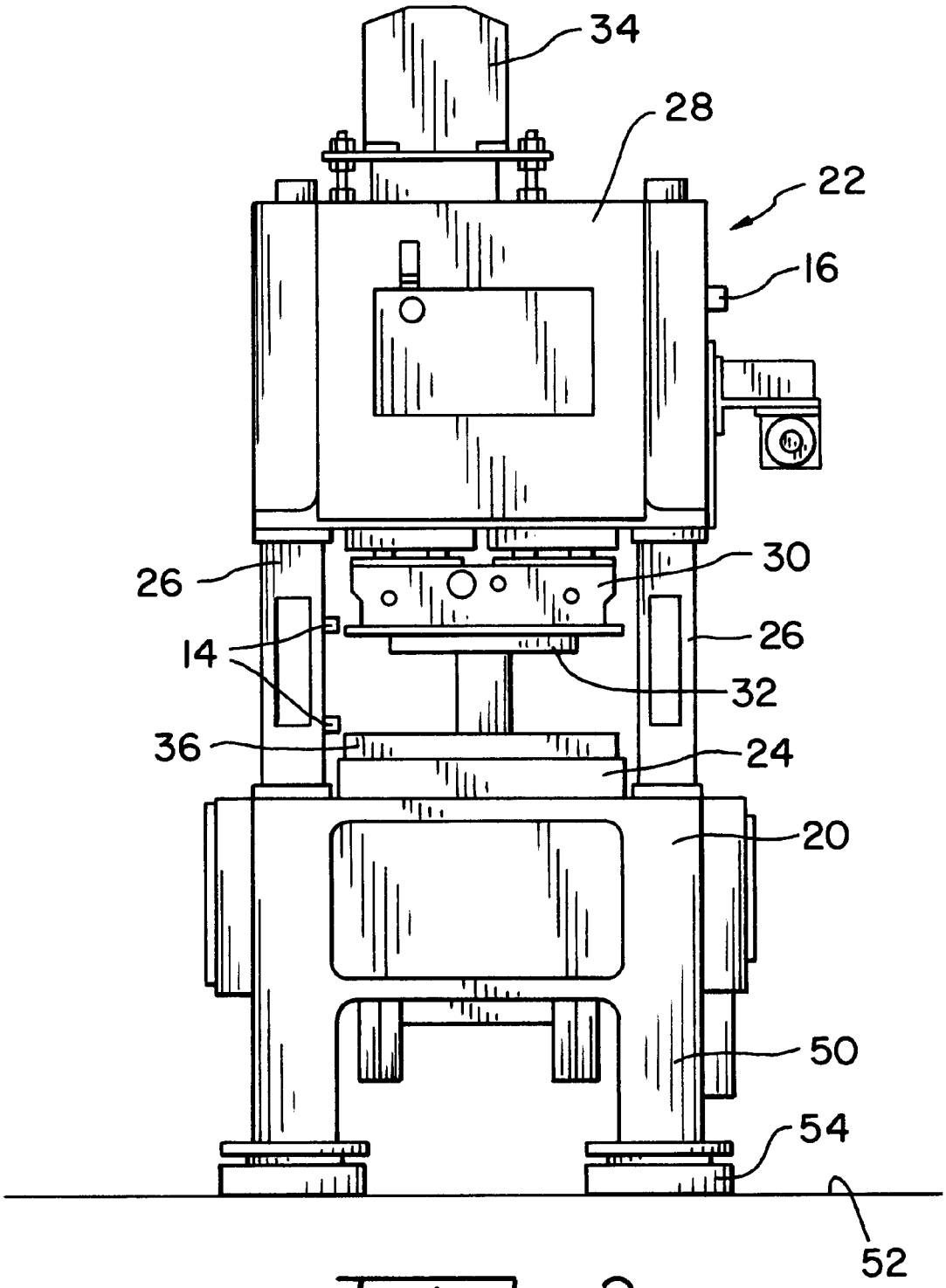
FIG. 2 is an elevational view of a typical press which is the subject of carry through monitoring.

Referring now to the drawings and particularly to FIG. 2, there is depicted a typical press 22 having a bed 20 with a bolster 24. Attached vertically to bed 20 are uprights 26 which support crown 28. Above crown 28 and attached thereto is press motor 34. Slide 30 is operatively connected so that during operation, press motor 34 causes slide 30 to reciprocate in rectilinear fashion toward and away from bed 20. Upper tooling 32 is operatively connected to slide 30. Lower tooling 36 is operatively connected to bolster 24. Leg members 50 are formed as an extension of bed 20 and are generally mounted to shop floor 52 by means of shock absorbing pads 54.

Figure 3:
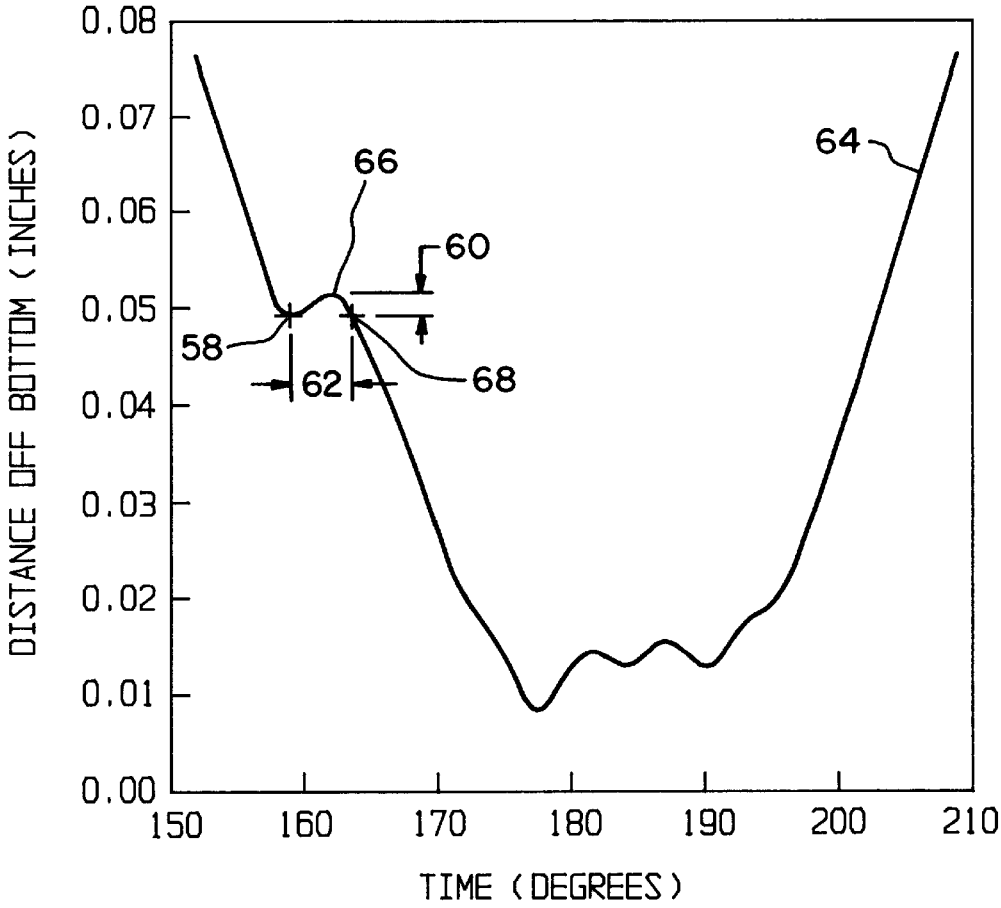
FIG. 3 is a graphical representation of an actual slide displacement curve.
Figure 4:
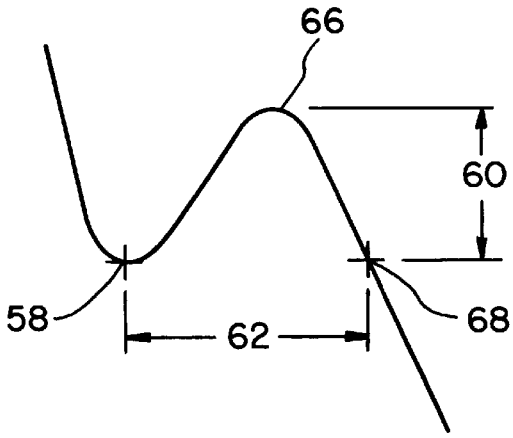
FIG. 4 is a magnified view of a portion of the actual slide displacement curve.

Generally, the present invention provides a method and apparatus for monitoring the carry through condition of a mechanical press. A mechanical press tends towards a carry through condition as slide bounce height and duration are lessened. A theoretical pure carry through condition is indicated when the slide experiences no bounce as it contacts the stock material. The present invention provides a method and apparatus for monitoring the carry through state of a mechanical press which utilizes parameters corresponding to rebound height 60 and rebound count 62 as illustrated in FIGS. 3 and 4.

Rebound height 60 corresponds to the height of the bounce experienced by the slide as it contacts the stock material while rebound count 62 corresponds to the count quantity elapsing during the bounce of the slide. The count quantity or measure of rebound count 62 is generally crank angle or time. In one embodiment, rebound height 60 and rebound count 62 are measured by first generating actual slide displacement curve 64 and measuring these quantities therefrom. Rebound number may additionally be utilized as an indicator of the carry through condition of a mechanical press. Rebound number provides a cumulative measure indicator of the number of bounces experienced by the slide as it contacts the stock material. In one embodiment, the rebound number of the press described by the curve in FIG. 4 would be one. Rebound number is a relative quantity and may relate the number of bounces occurring in a slide stroke in multiples greater than one. Rebound height and rebound count may also be indicated as cumulative numbers, i.e. the sum of all rebound heights and rebound counts experienced during a press operating condition which produces multiple slide bounces as the slide contacts the stock material.

Figure 1:
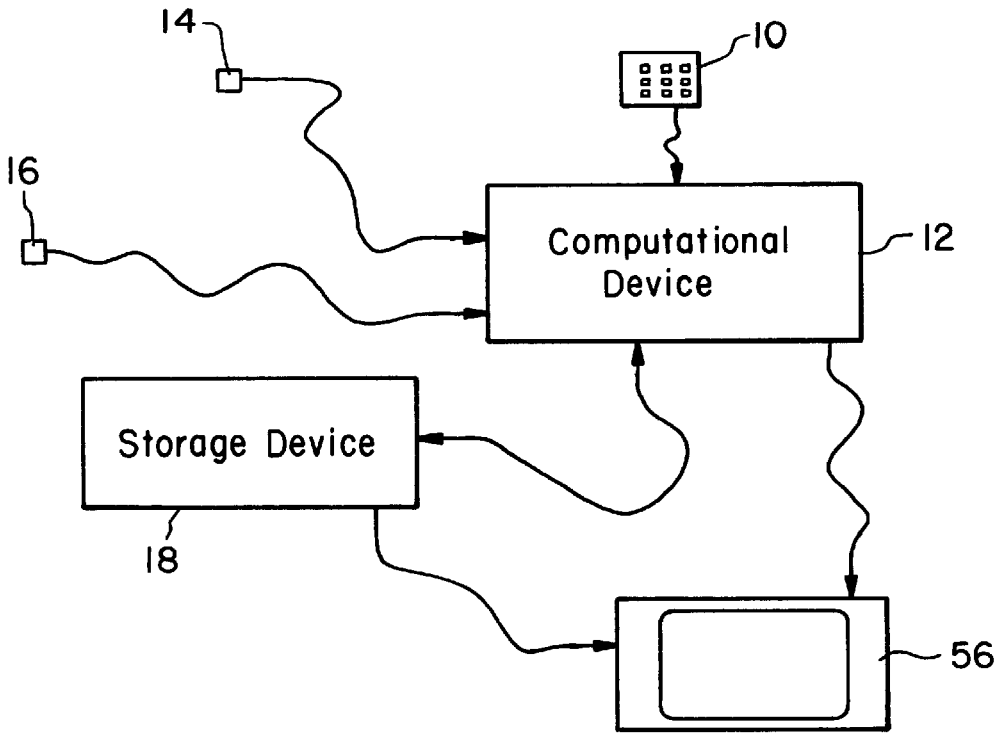
FIG. 1 is a schematic representation of an embodiment of the carry through monitoring apparatus.

FIG. 1 illustrates an embodiment of the current invention, wherein computational device 12 receives sensed slide position values from displacement sensor 14. Displacement sensor 14 can be a non-contact displacement sensor, for example, a hall effect sensor. In one embodiment, computational device 12 further receives a value of press speed (spm) from speed sensor 16. Displacement sensor 14 and speed sensor 16 are communicatively connected to computational device 12 and continuously relate measured values of press speed and slide displacement to computational device 12. Input means 10 are also communicatively connected to computational device 12 and are utilized to input press operational parameters, such as die number, stock material specifications including stock material hardness, and slide mass.

Computational device 12 continuously receives input from non-contact displacement sensor 14 and utilizes this information to generate actual slide displacement curve 64 (FIG. 3) for each slide stroke for the press being monitored. In this way, values of rebound height 60, rebound count 62, and rebound number can be obtained for each slide stroke. Computational device 12 additionally receives a value of press speed (spm) measured by speed sensor 16 as well as press operational parameters input via input means 10. Computational device 12 communicates measured values of rebound height 60, rebound count 62, and rebound number as well as measured values of press speed and input press operational parameters to storage device 18.

Storage device 18 is operable to create a database of measured values of rebound height 60, rebound count 62, and rebound number as well as the corresponding operational parameters for the press being monitored including the speed of the press at the time rebound height 60, rebound count 62, and rebound number are measured. Display device 56 is directly communicatively connected to computational device 12 and storage device 18 and may be utilized to display the various carry through condition indicators as well as press operational characteristics and other information stored in storage device 18.

As illustrated in FIG. 3, contact point 58 may be identified on actual slide displacement curve 64 as the first inflection point. Contact point 58 signals the slide position where the slide first contacts the stock material and is characterized by an inflection point due to the bounce experienced as the slide contacts the stock material. Bounce point 66 is characterized by a local maximum achieved after the slide contacts the stock material. Return point 68 is reached when the slide returns to a position that is the same distance from top dead center on the slide downstroke as contact point 58. Bounce point 66 and return point 68 are useful in determining rebound height 60 and rebound count 62. Computational device 12 continually identifies contact point 58, bounce point 66 and return point 68 for each slide stroke of the press being monitored. Computational device 12 then utilizes these quantities to measure rebound height 60 and rebound count 62.

Figure 6:
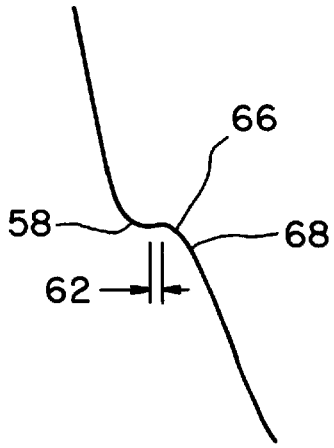
FIG. 6 is a magnified view of a portion of an actual slide displacement curve illustrating a press which has substantially achieved a theoretical pure carry through condition.
Figure 5:
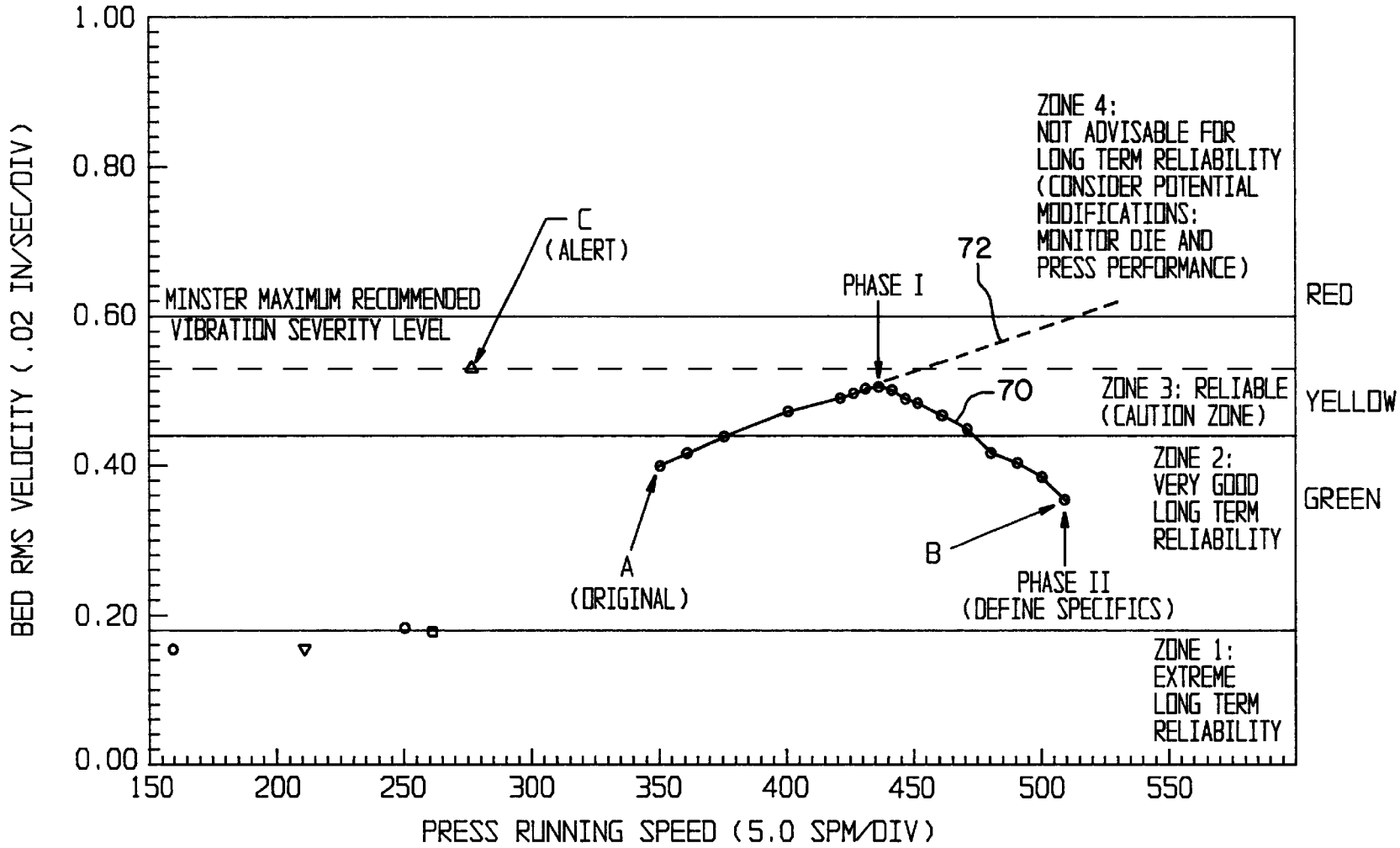
FIG. 5 is a graphical representation of vibration severity level for a mechanical press.

FIG. 5 illustrates in graphical form the vibration severity level experienced by a press being monitored. Construction and use of such a vibration severity chart is disclosed in U.S. Pat. No. 5,094,107, the disclosure of which is herein explicitly incorporated by reference. As seen in FIG. 5, a mechanical press which is experiencing significant bounce as the slide contacts the stock material will produce vibration severity levels in and above Zone 3 on the vibration severity/reliability zone chart. However, as the press is brought closer to a carry through state, vibration severity level is lessened and drops off as indicated by Line 70. Line 70 indicates a particular press operational state, wherein the press is operating at conditions closer to a carry through state than the press operating conditions as signified by Line 72. The closer the mechanical press is to a carry through state, the less severe the vibration severity level experienced by the press will be. FIG. 5 zones are color coded green, yellow, and red for the bed RMS readings obtained, preferred readings are in green, not advised operations occur in the red zone. Display 56 may give a color coded display depicting which zone the attached machine is operating in. FIG. 6 illustrates a portion of the actual slide displacement curve for a mechanical press operating extremely close to a theoretical pure carry through state.

The database of information constructed in storage device 18 may be utilized to determine optimum press operational characteristics which bring the press closer to a carry through condition. Slide mass is a particularly important press operational characteristic since slides of increased mass will be of higher energy levels during press operation and will tend to bring the press closer to a carry through state. The database of information may be utilized to determine an initial slide mass which should be utilized with a particular operational state of the mechanical press being monitored. Additionally, measured values of rebound height 60, rebound count 62, and rebound number may be utilized to indicate operating conditions, wherein additional mass should be added to the slide.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method of achieving a carry through state in a mechanical press, said mechanical press having a slide associated herewith and having a stock material loaded therein comprising:

determining a rebound height of the slide as it contacts the stock material; and adjusting press operational parameters in an effort to control a requisite energy content of the slide needed to minimize the rebound height of the slide as it contacts the stock material.

2. The method of claim 1, further comprising:

determining the rebound count of the slide as it contacts the stock material; and adjusting press operational parameters in an effort to minimize the rebound count of the slide as it contacts the stock material.

3. The method of claim 2, further comprising:

determining the rebound number of the slide as it contacts the stock material; and adjusting press operational parameters in an effort to minimize the rebound number of the slide as it contacts the stock material.

4. The method of claim 2, wherein said step of adjusting press operational parameters in an effort to minimize the rebound height of the slide as it contacts the stock material comprises:

increasing the energy of the slide.

5. The method of claim 4, wherein said step of increasing the energy of the slide comprises:

adding mass to the slide.

6. The method of claim 5, wherein said step of adjusting press operational parameters in an effort to minimize the rebound count of the slide as it contacts the stock material comprises:

increasing the energy of the slide.

7. The method of claim 6, wherein said step of increasing the energy of the slide comprises:

adding mass to the slide.

8. A method of achieving a carry through state in a mechanical press, comprising:

determining a rebound height of the slide as it contacts the stock material, wherein said step of determining the rebound height of the slide as it contacts the stock material comprises:

determining the contact point where the slide contacts the stock material;

determining a bounce point which corresponds to the position of the slide that is furthest from the contact point and is between the contact point and the top dead center point of the slide on the slide downstroke and which is reached after the slide contacts the stock material;

determining the distance along the slide path between the contact point and the bounce point; and establishing the distance along the slide path between the contact point and the bounce point as the rebound height; and adjusting press operational parameters in an effort to minimize the rebound height of the slide as it contacts the stock material;

determining the rebound count of the slide as it contacts the stock material;

adjusting press operational parameters in an effort to minimize the rebound count of the slide as it contacts the stock material;

determining the rebound number of the slide as it contacts the stock material; and adjusting press operational parameters in an effort to minimize the rebound number of the slide as it contacts the stock material.

9. The method of claim 8, further comprising:

providing a computational device;

communicating the contact point to the computational device;

communicating the bounce point to the computational device; and using the computational device to compute the distance along the slide path between the contact point and the bounce point.

10. The method of claim 9, wherein said step of determining the contact point where the slide contacts the stock material comprises:

creating an actual slide displacement curve;

determining the first inflection point on the actual slide displacement curve; and establishing the first inflection point on the actual slide displacement curve as the contact point.

11. The method of claim 10, wherein said step of creating an actual slide displacement curve comprises:

providing a non-contact displacement sensor;

monitoring slide position continuously during press operation; and plotting slide displacement versus a count quantity.

12. The method of claim 11, wherein said step of plotting slide displacement versus a count quantity comprises:

plotting slide displacement versus time.

13. The method of claim 11, wherein said step of plotting slide displacement versus a count quantity comprises:

plotting slide displacement versus crank angle.

14. The method of claim 10, wherein said step of determining the rebound count of the slide as it contacts the stock material comprises:

determining the return point which corresponds to the slide returning to a position that is the same distance from top dead center on the slide downstroke as the contact point;

determining the count quantity elapsing between the slide reaching the contact point and the slide reaching the return point; and establishing the count quantity elapsing between the slide reaching the contact point and the slide reaching the return point as the rebound count.

15. The method of claim 14, further comprising:

communicating the return point to the computational device; and using the computational device to determine the count quantity elapsing between the slide reaching the contact point and the slide reaching the return point.

16. The method of claim 14, wherein said step of determining the rebound number of the slide as it contacts the stock material comprises:

determining all inflection points which occur on the actual slide displacement curve from the dynamic top dead center position of the slide to the dynamic bottom dead center position of the slide; and calculating a quantity of rebound number utilizing the inflection points occurring on the actual slide displacement curve from the dynamic top dead center position of the slide to the dynamic bottom dead center position of the slide.

17. The method of claim 16, wherein said step of calculating a quantity of rebound number utilizing the inflection points occurring on the actual slide displacement curve from the dynamic top dead center position of the slide to the dynamic bottom dead center position of the slide comprises:

generating a cumulative number of inflection points occurring on the actual slide displacement curve from the dynamic top dead center of the slide to the dynamic bottom dead center of the slide; and establishing the cumulative number of inflection points occurring on the actual slide displacement curve from the dynamic top dead center of the slide to the dynamic bottom dead center of the slide as the rebound number.

18. The method of claim 16, wherein said step of calculating a quantity of rebound number utilizing the inflection points occurring on the actual slide displacement curve from the dynamic top dead center position of the slide to the dynamic bottom dead center position of the slide comprises:

generating a cumulative number of inflection points occurring on the actual slide displacement curve from the dynamic top dead center position of the slide to the dynamic bottom dead center position of the slide;

dividing the cumulative number of inflection points occurring on the actual slide displacement curve by two; and establishing the cumulative number of inflection points occurring on the actual slide displacement curve divided by two as the rebound number.

19. A method of achieving a carry through state in a mechanical press, said mechanical press having a slide associated therewith and having a stock material loaded therein comprising:

determining a rebound count of the slide as it contacts the stock material; and adjusting press operational parameters in an effort to minimize the rebound count of the slide as it contacts the stock material.

20. A method of achieving a carry through state in a mechanical press, said mechanical press having a slide associated therewith and having a stock material loaded therein comprising:

determining a rebound number of the slide as it contacts the stock material; and adjusting press operational parameters in an effort to control a requisite energy content of the slide needed to minimize the rebound number of the slide as it contacts the stock material.

21. A method of decreasing the vibration severity level of a mechanical press, said mechanical press having a slide associated therewith and having a stock material loaded therein comprising:

monitoring a carry through condition of the press; and adjusting press operational parameters in response to the monitored carry through condition of the press to control a requisite energy content of the slide needed to bring thereby the operational state of the press being monitored closer to a carry through state.

22. The method of claim 21, wherein said step of monitoring the carry through condition of the press comprises:

determining the rebound height of the slide as it contacts the stock material.

23. The method of claim 22, wherein said step of monitoring the carry through condition of the press further comprises:

determining the rebound count of the slide as it contacts the stock material.

24. The method of claim 23, wherein said step of monitoring the carry through condition of the press further comprises:

determining the rebound number of the slide as it contacts the stock material.

25. The method of claim 21, wherein said step of adjusting press operational parameters in response to the monitored carry through condition of the press to bring the operational state of the press being monitored closer to a carry through state comprises:

increasing the kinetic energy of the slide.

26. The method of claim 25, wherein said step of increasing the kinetic energy of the slide comprises:

adding mass to the slide.

27. A method of decreasing the vibration severity level of a mechanical press, comprising:

monitoring the carry through condition of the press, wherein said step of monitoring the carry through condition of the press comprises:

determining the rebound height of the slide as it contacts the stock material, wherein said step of determining the rebound height of the slide as it contacts the stock material comprises:

determining the contact point where the slide contacts the stock material;

determining the bounce point which corresponds to the position of the slide that is furthest from the contact point and is between the contact point and the top dead center point of the slide on the slide downstroke and which is reached after the slide contacts the stock material;

determining the distance along the slide path between the contact point and the bounce point; and establishing the distance along the slide path between the contact point and the bounce point as the rebound height;

determining the rebound count of the slide as it contacts the stock material; and determining the rebound number of the slide as it contacts the stock material;

adjusting press operational parameters in response to the monitored carry through condition of the press to bring the operational state of the press being monitored closer to a carry through state.

28. The method of claim 27, further comprising:

providing a computational device;

communicating the contact point to the computational device;

communicating the bounce point to the computational device; and using the computational device to compute the distance along the slide path between the contact point and the bounce point.

29. The method of claim 28, wherein said step of determining the contact point where the slide contacts the stock material comprises:

creating an actual slide displacement curve;

determining the first inflection point on the actual slide displacement curve; and establishing the first inflection point on the actual slide displacement curve as the contact point.

30. The method of claim 29, wherein said step of creating an actual slide displacement curve comprises:

providing a non-contact displacement sensor;

monitoring slide position continuously during press operation; and plotting slide displacement versus a count quantity.

31. The method of claim 29, wherein said step of determining the rebound count of the slide as it contacts the stock material comprises:

determining the return point which corresponds to the slide returning to a position that is the same distance from top dead center on the slide downstroke as the contact point;

determining the count quantity elapsing between the slide reaching the contact point and the slide reaching the return point; and establishing the count quantity elapsing between the slide reaching the contact point and the slide reaching the return point as the rebound count.

32. The method of claim 31, further comprising:

communicating the return point to the computational device; and using the computational device to determine the count quantity elapsing between the slide reaching the contact point and the slide reaching the return point.

33. An apparatus useful to achieve a carry through state in a mechanical press having a reciprocating slide, said apparatus comprising:

a computational device;

a displacement sensor, said displacement sensor operatively connected to the press, whereby said displacement sensor is operative to sense the location of the press slide during press operation, said displacement sensor communicatively connected to said computational device, said computational device continually creating an actual slide displacement curve for each pressing cycle of the press being monitored, said computational device obtaining a value of rebound height and a value of rebound count from said slide displacement curve; and a display device, said display device communicatively connected to said computational device, whereby said display device is operative to display said value of rebound height and said value of rebound count.

34. The apparatus as recited in claim 33, wherein said computational device comprises:

a microprocessor.

35. The apparatus as recited in claim 33, wherein said displacement sensor comprises:

a non-contact displacement sensor.

36. The apparatus as recited in claim 35, wherein said non-contact displacement sensor comprises:

a hall effect sensor.

37. The apparatus as recited in claim 36, wherein the slide includes a plurality of areas operable for adding mass to the slide.

38. A method of achieving a carry through state in a mechanical press, comprising:

determining a rebound height of the slide as it contacts the stock material, wherein said step of determining the rebound height of the slide as it contacts the stock material comprises:

determining the contact point where the slide contacts the stock material;

determining the bounce point which corresponds to the position of the slide that is furthest from the contact point and is between the contact point and the top dead center point of the slide on the slide downstroke and which is reached after the slide contacts the stock material;

determining the distance along the slide path between the contact point and the bounce point; and establishing the distance along the slide path between the contact point and the bounce point as the rebound height; and adjusting press operational parameters in an effort to minimize the rebound height of the slide as it contacts the stock material.

39. A method of decreasing the vibration severity level of a mechanical press, comprising:

monitoring the carry through condition of the press, said step of monitoring the carry through condition of the press including determining the rebound height of the slide as it contacts the stock material, said step of determining the rebound height of the slide as it contacts the stock material comprising the substeps of:

determining the contact point where the slide contacts the stock material;

determining the bounce point which corresponds to the position of the slide that is furthest from the contact point and is between the contact point and the top dead center point of the slide on the slide downstroke and which is reached after the slide contacts the stock material;

determining the distance along the slide path between the contact point and the bounce point; and establishing the distance along the slide path between the contact point and the bounce point as the rebound height;

adjusting press operational parameters in response to the monitored carry through condition of the press to bring the operational state of the press being monitored closer to a carry through state.

* * * * *